US007588426B2

(12) United States Patent
De Palma et al.

(10) Patent No.: US 7,588,426 B2
(45) Date of Patent: Sep. 15, 2009

(54) OIL ROTARY VACUUM PUMP AND MANUFACTURING METHOD THEREOF

(75) Inventors: Giuseppe De Palma, Turin (IT); Roberto Carboneri, Turin (IT)

(73) Assignee: Varian, S.p.A., Leini, Turin (IT)

( * ) Notice: Subject to any disclaimer, the term of this patent is extended or adjusted under 35 U.S.C. 154(b) by 488 days.

(21) Appl. No.: 11/118,863

(22) Filed: Apr. 29, 2005

(65) Prior Publication Data

US 2005/0244286 A1 Nov. 3, 2005

(30) Foreign Application Priority Data

Apr. 30, 2004 (IT) ..... TO2004A0268

(51) Int. Cl.
*F03C 2/00* (2006.01)
*F03C 4/00* (2006.01)
*F04C 15/00* (2006.01)

(52) U.S. Cl. ..... 418/1; 418/39; 418/149; 418/181; 418/270; 277/609; 277/616; 277/625; 277/634

(58) Field of Classification Search ..... 418/1, 418/39, 107, 144, 149, 258, 181, 270; 277/609, 277/616, 625, 634
See application file for complete search history.

(56) References Cited

U.S. PATENT DOCUMENTS

| | | | | | |
|---|---|---|---|---|---|
| 2,318,346 | A | * | 5/1943 | Wakefield | 418/258 |
| 2,782,725 | A | * | 2/1957 | Hojberg | 418/258 |
| 3,580,315 | A | * | 5/1971 | Schnell | 241/86 |
| 4,979,885 | A | * | 12/1990 | Yasuda et al. | 418/270 |
| 5,988,223 | A | * | 11/1999 | Kanzaki et al. | 138/89 |
| 6,019,585 | A | | 2/2000 | Abelen et al. | |

FOREIGN PATENT DOCUMENTS

| | | | |
|---|---|---|---|
| DE | 35 42 420 | A1 | 6/1987 |
| EP | 0 845 599 | A1 | 6/1998 |
| GB | 2 151 091 | A | 7/1985 |
| JP | 07139486 | A | 5/1995 |
| JP | 2002161993 | A | 6/2002 |
| WO | WO 97/04236 | A | 2/1997 |

* cited by examiner

*Primary Examiner*—Theresa Trieu
(74) *Attorney, Agent, or Firm*—Bella Fishman

(57) ABSTRACT

An oil rotary vacuum pump of mechanical type (100) is filled with a requested amount of oil at the end of the manufacturing process, then it is stored and then shipped to the user, letting the user to avoid an operation of introducing the proper amount of oil into the pump. The oil leakage is prevented by securing the suction and/or exhaust ports (3, 17) of the pump, which are sealed by means of a removable sealing member, for instance by means of a membrane (21, 23).

7 Claims, 4 Drawing Sheets

OIL ROTARY VACUUM PUMP AND MANUFACTURING METHOD THEREOF

CROSS-REFERENCE TO RELATED APPLICATIONS

This application claims Paris Convention priority of Italian Patent Application No. TO2004A000268 filed Apr. 30, 2004, the complete disclosure of which is hereby incorporated by reference.

BACKGROUND OF THE INVENTION

The present invention relates to an oil rotary vacuum pump of mechanical type and to a method of manufacturing such pump.

Oil rotary pumps of mechanical type are generally used to obtain low vacuum conditions, in a pressure range from atmospheric pressure to about $10^{-1}$ Pa.

Conditional mechanical pumps include a casing, having a suction port and an exhaust port, within which a stator is provided defining a cylindrical chamber housing an eccentric circular rotor equipped with spring-loaded radial vanes. Said pumps are immersed into an oil bath, which has to cool down and lubricate the pump and to isolate if from the outside environment.

Pumps of such kind are known for instance from the U.S. Pat. No. 6,019,585 "Oil-Sealed Vane-Type Rotary Vacuum Pump With Oil Feed" and the GB Patent Application No. 2151091A "Electric Drive for Oil Sealed Sliding Vane Rotary Vacuum Pump."

According to the prior art, manufactured pumps are stored and subsequently shipped to the user without oil inside them. Thus, it is up to the user, who often has no skill in the art, to introduce the proper amount of oil into the pump prior to the first use.

It is clear that such a way of proceeding has a serious drawback: indeed, if the user does not perform the oil filling of the pump properly, severe risks of damaging the pump are encountered, in particular because of seizure of the moving parts due to the lack or insufficiency of lubricant.

Therefore, it is an object of the present invention to obviate the above-identified drawback, by providing an oil rotary pump of mechanical type, which can be filled with the proper amount of oil at the end of the manufacturing process and shipped to the user in such conditions.

It is another object of the present invention to provide an oil rotary pump of mechanical type already containing the proper amount of oil, which pump can be stored for any period of time and subsequently shipped to the user without any risk of the oil coming out or undergoing degradation.

SUMMARY OF THE INVENTION

The above-identified and other objects are achieved by means of an oil rotary vacuum pump of mechanical type according to the invention, as claimed in the appended claims.

Due to the sealing of the suction and exhaust ports in the pump by suitable membranes, oil which is introduced into the pump cannot come out during storage and shipping operations, so that the end user receives the pump already containing the proper amount of oil.

Advantageously, the methods employed in order to apply these membranes to the respective ports are chosen so that the membranes can be easily removed by the user before starting the pump operations.

Moreover, the material and the thickness of the membranes are chosen so that, even if the user forgot removing the membranes from the ports before using the pump, said membranes tear when the pump is started, leaving the ports free without damaging the components of the pump or of devices connected thereto.

BRIEF DESCRIPTION OF THE DRAWINGS

Some non-limiting exemplary embodiments of the pump according to the invention will be described in more detail hereinafter, with reference to the accompanying drawings, in which.

DETAILED DESCRIPTION OF THE PREFERRED EMBODIMENTS

Figure 1:
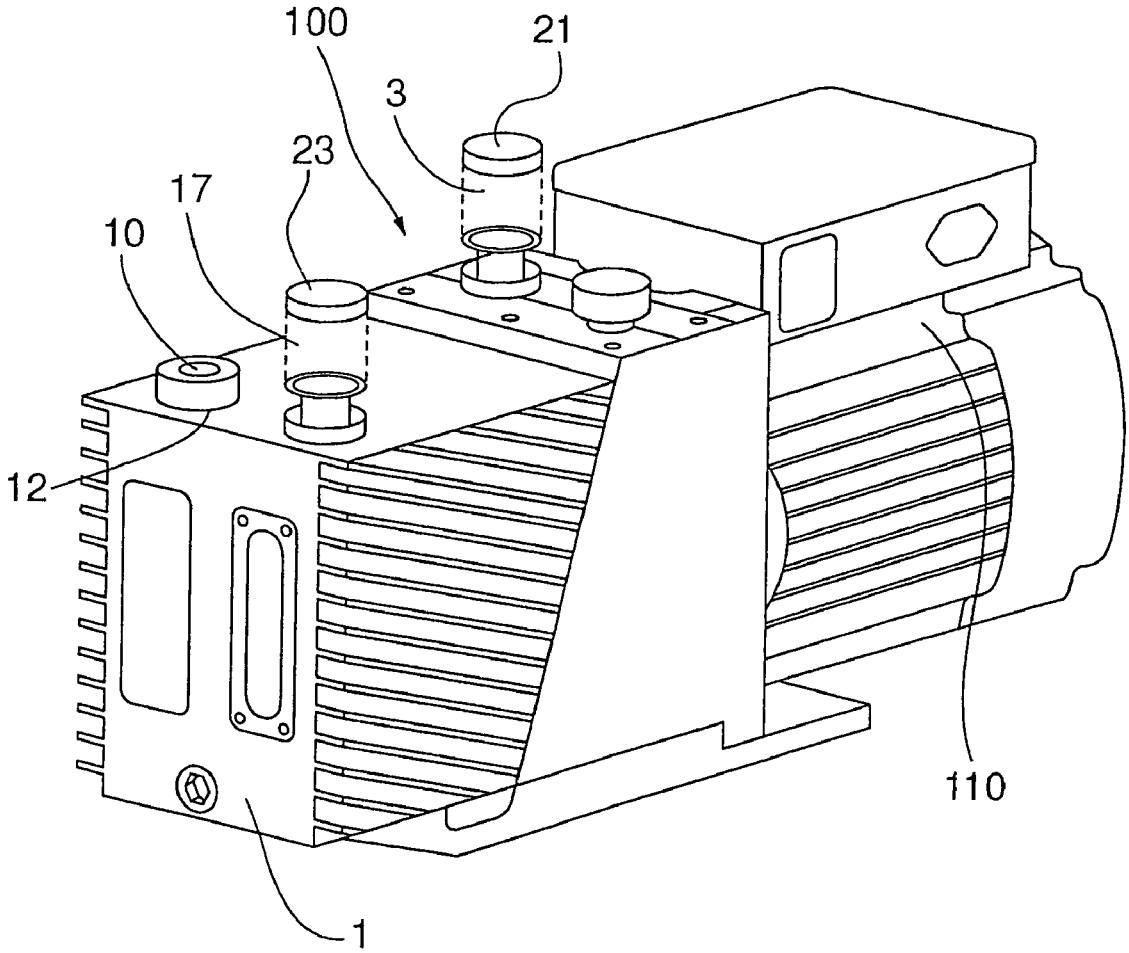
FIG. 1 is a perspective schematic view of the oil rotary mechanical vacuum pump according to the present invention.
Figure 2:
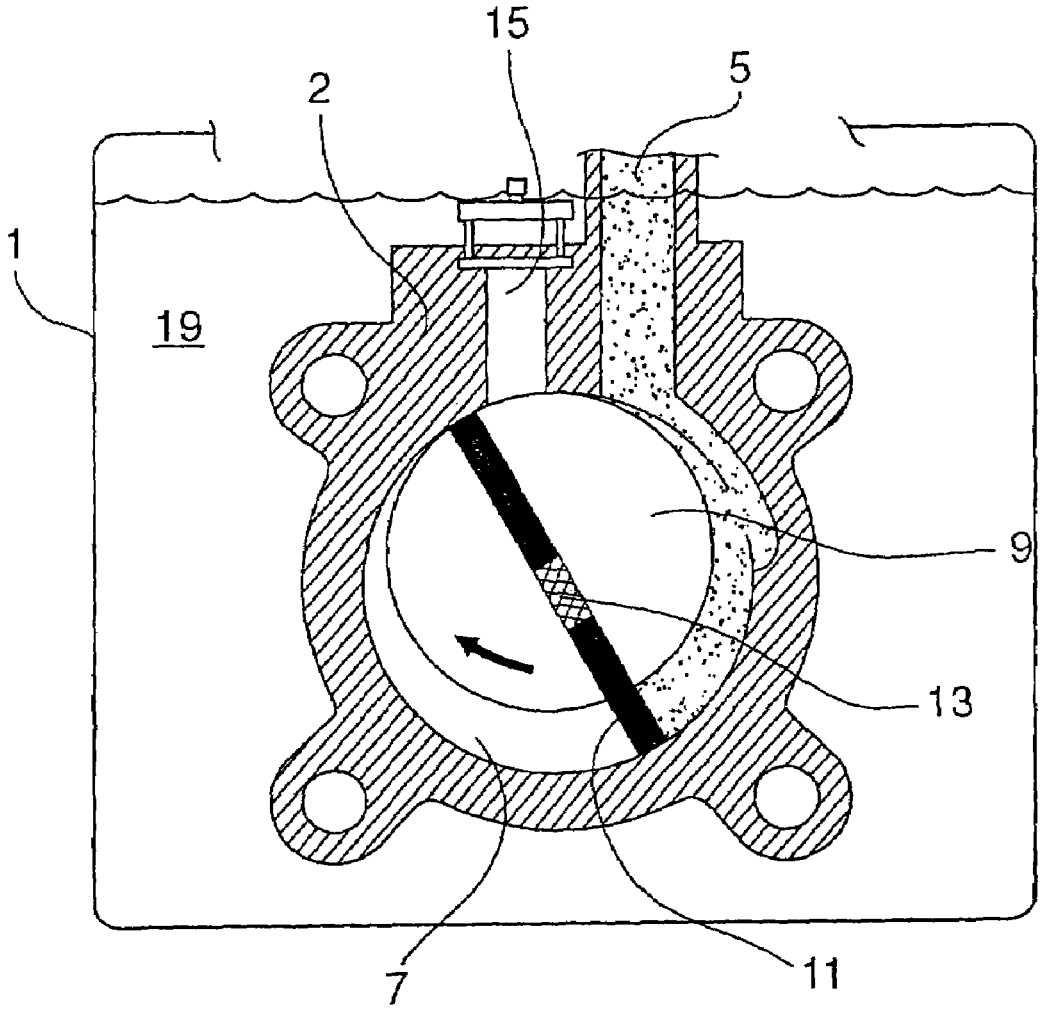
FIG. 2 is a schematic cross-sectional view of the vacuum pump shown in FIG. 1.

Referring to FIGS. 1 and 2, mechanical oil pump 100 according to the invention comprises an external casing in which an internal casing, having a cylindrical chamber 7 formed therein, is tightly arranged. The chamber 7 houses a cylindrical rotor 9, driven into rotation by a motor 110 connected to pump 100. The rotor has an axis parallel to the axis of cylindrical chamber 7, but eccentrically located relative to the chamber axis. One or more radially movable radial vanes 11 (two vanes in the embodiment shown) are mounted onto rotor 9 and are kept against the wall of chamber 7 by means of springs 13.

Gas is sucked through suction port 3 and enters, through a suction duct 5, chamber 7, where it is pushed by the vanes, and hence compressed. Subsequently, gas is released through an exhaust duct 15 ending at a corresponding exhaust port 17.

External casing 1 is filled with a suitable amount of oil, such that the second, tightly arranged casing 2 is immersed into an oil bath 19 acting as cooling and lubricating fluid. In a known manner, pump 100 is indeed manufactured so that a certain amount of oil can penetrate into chamber 7 and form a thin film ensuring tightness between vanes 11 of rotor 9 and the wall of chamber 7.

Advantageously, according to the invention, at the end of the manufacturing process, the proper amount of oil is introduced into external casing 1, through a proper introduction port 12 sealed by a plug 10, in order to form oil bath 19, and suction and exhaust ports 3, 17 are sealed by means of a pair of membranes 21, 23 for the subsequent storage and shipping operations.

Figure 3:
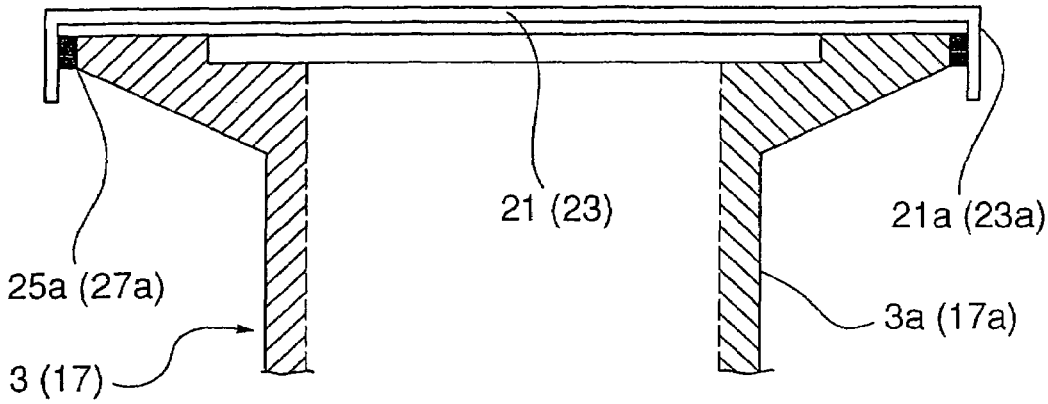
FIG. 3 is a schematic cross-sectional view of a detail of FIG. 1, concerning the suction/exhaust port of the pump according to the present invention.

As better shown in FIG. 3, the membranes 21, 23 can be applied to the respective suction and exhaust ports 3 and 17 by gluing, so that a portion 21*a*, 23*a* of each the membrane 21, 23 is made to adhere to outer surface 3*a*, 17*a* of port 3, 17, respectively, through a layer 25*a*, 27*a* of a proper adhesive, thereby sealing said port.

Figure 4:
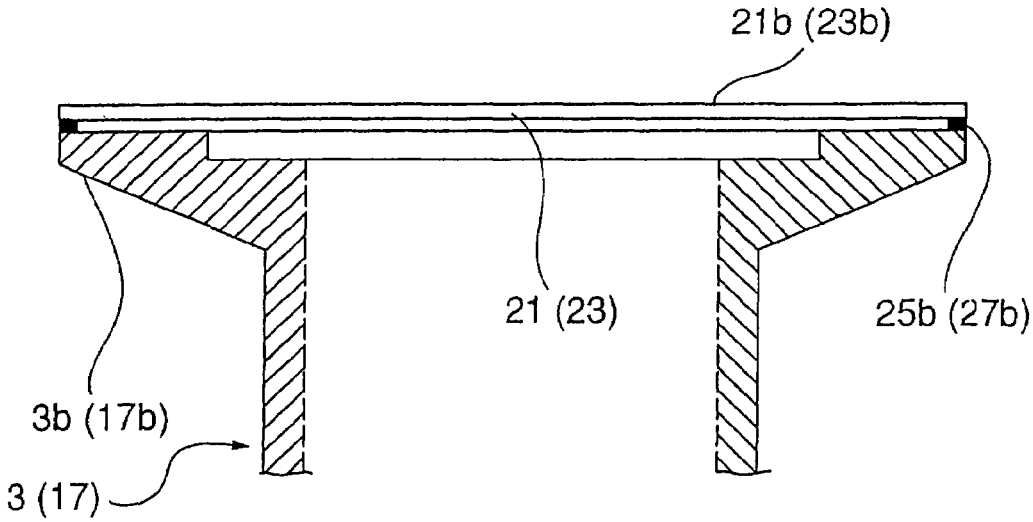
FIG. 4 is a schematic cross-sectional view of the detail shown in FIG. 3.

In the alternative, according to the embodiment shown in FIG. 4, a portion 21*b*, 23*b* of said membranes 21, 23 is made to adhere to rim 3*b*, 17*b* of port 3, 17, respectively, through a layer 25*b*, 27*b* of said adhesive.

In both embodiments described, the adhesive is selected so that it ensures a perfect tightness of said membranes on said ports, while allowing an easy and complete removal of said membranes by the operator when the pump is to be used.

Figure 5:
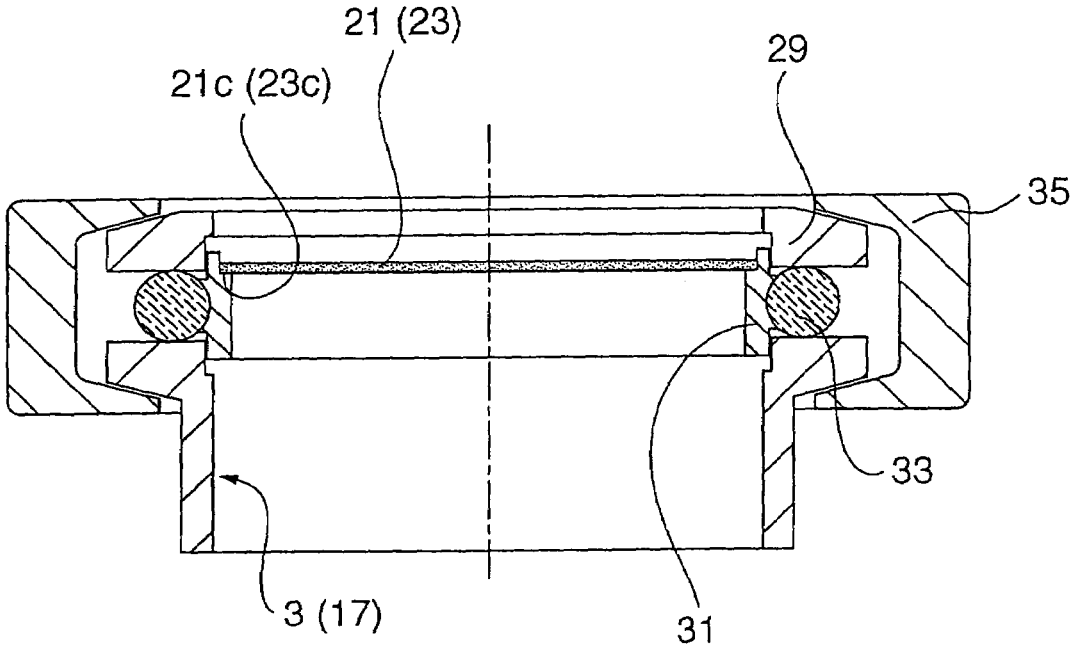
FIG. 5 is a schematic cross-sectional view of the detail shown in FIG. 3, according to an alternative embodiment.

Turning to FIG. 5, an alternative embodiment of the invention is shown. According to this embodiment, a flange 29 is applied to the suction and exhaust ports of pump 100 and is kept in register with the respective port 3, 17 by means of a centring ring and a ring gasket 33. The flange 29 can be kept pressed against the respective port by a locking nut 35 during the storage and shipping steps, and subsequently removed when the pump is to be used.

According to this embodiment, membranes 21, 23 are applied to the centring ring 31 and not directly to suction or exhaust port 3, 17. More particularly, a peripheral portion 21*c*, 23*c* of each membrane 21, 23 can be made to adhere to the inner surface of centring ring 31.

This second embodiment entails important advantages.

First, membranes 21, 23 could be secured to centring ring 31 even in a non-removable manner, since the ring 31 will be removed together with the respective membrane before starting the pump. Consequently, any conventional technique (gluing, welding, crimping, etc.) could be used for securing the membranes 21, 23 to the respective centring ring 31.

Second, said membranes 21, 23 do not undergo any deterioration when they are removed from suction and exhaust ports 3, 17, and therefore they can be used again in case of a possible further storage and/or shipping, by simply applying again the respective centring ring 31 and the respective flange 29 on each port.

In general manner, these membranes are made as very thin films, so that a moderate pressure difference is enough to tear them. In this way, even if the user forgot removing them before starting pump 100, when starting the pump the pressure exerted on said membranes because of rotor 7 being driven into rotation would be enough to make them tear, thus leaving ports 3, 17 of pump 100 unobstructed and without producing fragments that could damage the pump.

It is clear that the vacuum pump according to the invention attains the desired objects, in that it lets the user off the delicate operation of introducing the proper amount of oil into the pump when first starting the same pump.

Moreover, the provision of sealing membranes on the suction and/or exhaust ports of the pump according to the invention allows storing the pump for any time period and then shipping it without risks of oil leakage and consequent soiling of the pump of its packing.

What is claimed is:

1. A method of manufacturing an oil rotary vacuum pump of mechanical type (100), comprising the steps of:

providing external (1) and internal (2) casings with a suction duct (5) including a suction port (3) and an exhaust duct (15) including and an exhaust port (17);

positioning a rotor (9) within a chamber (7) forming within the internal casing;

providing an opening (12) within the external casing;

creating an oil bath (19) by poring through the opening (12) a requested amount of oil to immerse the internal casing therein;

closing the opening (12);

applying a sealing member (21, 23) to the suction port (3) and/or the exhaust port (17), wherein said sealing member (21, 23) comprises a membrane (21, 23) formed of a thin film subject to tearing without producing fragments thereof on application of a pressure difference across the film, whereby said oil bath is not diminished from leakage out of said suction port (3) and/or exhaust port (17) during shipment or storage; and removing said sealing member (21, 23) before starting said pump for the first time.

2. The method as claimed in claim 1, further comprising adhering the membrane (21, 23) to said port (3, 17).

3. The method as claimed in claim 2, further comprising adhering the membrane (21, 23) to said port (3, 17) by gluing, welding or crimping.

4. The method as claimed in claim 3, further comprising adhering the membrane to an outer surface (3*a*, 17*a*) of said port (3, 17).

5. The method as claimed in claim 3, further comprising adhering the membrane to a rim (3*b*, 17*b*) of said port (3, 17).

6. The method as claimed in claim 1, wherein a sealing member comprises a membrane (21, 23), a flange (29), a centring ring (31), arranged between said flange and said suction and/or exhaust port (3, 17) and a removable locking nut (35) for retaining said flange (29) and said ring (31) against said port (3, 17).

7. The method as claimed in claim 6, further comprising applying said membrane (21, 23) to the centring ring (31).

* * * * *